US011438707B2

(12) United States Patent
Best et al.

(10) Patent No.: US 11,438,707 B2
(45) Date of Patent: Sep. 6, 2022

(54) METHOD FOR OPERATING A HEARING AID SYSTEM, AND HEARING AID SYSTEM

(71) Applicant: Sivantos Pte. Ltd., Singapore (SG)

(72) Inventors: Sebastian Best, Erlangen (DE); Thomas Pilgrim, Erlangen (DE); Cecil Wilson, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 51 days.

(21) Appl. No.: 17/095,007

(22) Filed: Nov. 11, 2020

(65) Prior Publication Data

US 2021/0067884 A1 Mar. 4, 2021

Related U.S. Application Data

(63) Continuation of application No. PCT/EP2019/080089, filed on Nov. 4, 2019, and a continuation of application No. PCT/EP2019/061750, filed on May 7, 2019.

(30) Foreign Application Priority Data

May 11, 2018 (DE) ..... 102018207343

(51) Int. Cl.
*H04R 25/00* (2006.01)
*H04R 25/02* (2006.01)

(52) U.S. Cl.
CPC ..... *H04R 25/43* (2013.01); *H04R 25/45* (2013.01); *H04R 25/02* (2013.01); *H04R 2225/41* (2013.01); *H04R 2225/43* (2013.01)

(58) Field of Classification Search
None
See application file for complete search history.

(56) References Cited

U.S. PATENT DOCUMENTS

| | | | |
|---|---|---|---|
| 6,198,830 | B1 | 3/2001 | Holube et al. |
| 7,773,763 | B2 | 8/2010 | Pedersen |
| 2007/0140512 | A1 | 6/2007 | Hain et al. |
| 2012/0082330 | A1 | 4/2012 | Kornagel et al. |
| 2016/0112811 | A1 | 4/2016 | Jensen et al. |
| 2016/0381468 | A1 | 12/2016 | Petrausch et al. |

FOREIGN PATENT DOCUMENTS

| | | | |
|---|---|---|---|
| DE | 102005061000 | A1 | 6/2007 |
| DE | 102010041740 | A1 | 4/2012 |
| EP | 2908550 | A1 | 8/2015 |

*Primary Examiner* — Mark Fischer
(74) *Attorney, Agent, or Firm* — Laurence A. Greenberg; Werner H. Stemer; Ralph E. Locher

(57) ABSTRACT

A method operates a hearing aid system in which a dynamic range scheme for an automatic gain control is modified depending on the situation. A gain factor is set by the automatic gain control which has a dynamic range processor operated with a dynamic range scheme defining the gain factor in dependence on a level of an input signal. A corresponding hearing aid system carries out this method.

18 Claims, 2 Drawing Sheets

METHOD FOR OPERATING A HEARING AID SYSTEM, AND HEARING AID SYSTEM

CROSS-REFERENCE TO RELATED APPLICATION

This application is a continuation, under 35 U.S.C. § 120, of copending international application No. PCT/EP2019/061750, filed May 7, 2019, and PCT/EP2019/080089, filed Nov. 4, 2019 which designated the United States; this application also claims the priority, under 35 U.S.C. § 119, of German patent application No. DE 10 2018 207 343, filed May 11, 2018; the prior applications are herewith incorporated by reference in their entirety.

BACKGROUND OF THE INVENTION

Field of the Invention

The invention relates to a method for operating a hearing aid system and to a corresponding hearing aid system.

In its most general form, a hearing aid system contains a signal processor and a receiver, wherein the receiver is also referred to as a speaker. The signal processor is fed an input signal which is then modified by the signal processor, so that an output signal is generated which is therefore a modified input signal. For example, the input signal is amplified with a certain gain factor. In the following, the input signal and the output signal are generally also referred to as signals. The output signal is finally output by means of the receiver. The input signal and the output signal are electrical signals. The receiver then converts the output signal into a sound signal.

Optionally, the hearing aid system also has a microphone, which generates the input signal by capturing one or more sound signals from the environment and converting them into the input signal. Such a hearing aid system with an additional microphone is also referred to as a hearing aid and is used, for example, to treat a hearing-impaired person by using the hearing aid to amplify sound signals from the environment and output them to the person as amplified sound signals.

In hearing aid systems, it is possible to perform a non-linear amplification instead of a simple linear amplification. This is implemented, for example, with a so-called compressor, which provides and applies a compression scheme which sets the gain factor appropriately for the modification of the input signal, i.e. for generating the output signal. The response of the compressor, i.e. the compression scheme, is defined by one or more parameters, more precisely compression parameters.

U.S. Pat. No. 7,773,763 B2 describes a hearing aid in which different programs are associated with different types of environment. Each program contains specific values for specific hearing aid parameters to achieve optimal signal quality in a given environment. The hearing aid can classify the current environment, assign it to an environment type, and then select a suitable program with appropriate optimal parameters.

Published, non-prosecuted German patent application DE 10 2005 061 000 A1, corresponding to U.S. patent publication No. 2007/0140512, describes a method in which the system switches between two compression algorithms depending on a classification result.

Published, non-prosecuted German patent application DE 10 2010 041 740 A1, corresponding to U.S. patent publication No. 2012/0082330, describes a method in which different dynamic range compressions are performed on different frequency bands.

BRIEF SUMMARY OF THE INVENTION

Against this background, an object of the invention is to specify an improved method for operating a hearing aid system and a corresponding hearing aid system. In particular, the aim is to improve the dynamic range of a hearing aid system having an automatic gain control.

The object is achieved according to the invention by a method having the features as claimed in the independent method claim and by a hearing aid system having the features as claimed in the independent hearing aid claim. Advantageous configurations, extensions and variants form the subject matter of the dependent claims. The comments in relation to the method also apply, mutatis mutandis, to the hearing aid system, and vice versa.

The method is used to operate a hearing aid system, and it is therefore an operating method. In operation, the hearing aid system is worn by a user, in particular on, in or behind the ear, i.e. generally on the head and in the region of one or both ears. At a given time, the hearing aid system and the user are in a current acoustic environment. This means that the environment around the user and the hearing aid system at the present time forms a certain acoustic scene.

The hearing aid system has a signal processor, which generates an output signal of the hearing aid system from an input signal of the hearing aid system by amplifying the input signal with a gain factor. The signal processor thus acts as an amplifier. The signal processor is preferably integrated into the hearing aid system. The hearing aid system is preferably a hearing device, particularly preferably a hearing aid for treating a person with a hearing impairment. As a hearing aid, the hearing aid system has at least one microphone which captures acoustic signals, i.e. sound signals from the environment, and converts them into an input signal. The hearing aid system also has a receiver, via which the output signal, i.e. the amplified input signal, is output. The receiver is also referred to as a speaker.

The gain factor is set by an automatic gain control, which is in particular a part of the signal processor. Automatic gain control is also referred to as AGC for short. In particular, "automatic" means that no user input is required to perform the gain control, but that this is carried out automatically during operation. In addition to the automatic gain control, in a suitable design the hearing aid system also has a manual gain control, which allows the user to control the gain factor as desired.

The automatic gain control has a dynamic range processor, which can be operated with a dynamic range scheme which defines the gain factor as a function of an input signal level, i.e. the input level. The dynamic range scheme therefore indicates which gain factor is used at which input level. The dynamic range scheme is also known as a dynamic range algorithm. Examples of dynamic range schemes are generally compression or expansion schemes and specifically AGCi (automatic gain control input dependent) and ADRO (adaptive dynamic range optimization). Various dynamic range schemes are suitable in the present case, AGCi being particularly preferred.

A characteristic of a dynamic range processor is that the gain factor is precisely not constant, rather that the dynamic range processor gives rise to a non-linear amplification. In particular, the dynamic range processor controls the gain provided by the signal processor as a function of a controlled variable. For example, the input level, or alternatively the output level, is used as the control variable. Both variants have specific advantages and disadvantages. The particular level is measured, for example, by means of a level detector, which advantageously forms part of the hearing aid system.

Generally, the input signal and the output signal each have a dynamic range, i.e. a level that lies within a certain range from a minimum level to a maximum level. The level of the input signal is also referred to as the input level, and the level of the output signal is correspondingly referred to as the output level. Similarly, the dynamic range of the input signal is referred to as the input dynamic range, and the dynamic range of the output signal as the output dynamic range. The dynamic range of the output signal depends on the dynamic range of the input signal and on the modification by the signal processor. In certain use cases, it is desirable to limit, i.e. to compress, the dynamic range of the output signal, or to increase, i.e. expand it. In the case of a hearing aid for a hearing-impaired person, the dynamic range is conveniently adapted to suit the hearing-impaired person's reduced hearing capacity compared to people with normal hearing. The reduced hearing capacity is limited to a certain level range, which then conveniently defines the dynamic range of the output signal. The dynamic range of the input signal is then mapped to the level range by generating the output signal with an equally suitable dynamic range, in particular to achieve maximum sound quality. Depending on the design, it is then advantageous to perform a compression or expansion, or even a combination of the two.

In operation, the hearing aid is operated in a specific program to which a dynamic range scheme is assigned. The program therefore sets the dynamic range processor in a predefined way, i.e. pre-configures it. The program and the dynamic range scheme are conveniently adapted to the current acoustic environment, so that an optimal output, i.e. output quality, is obtained. The dynamic range processor is therefore operated in the one program with the associated dynamic range during operation.

A key idea of the invention is now the fact that at least one situation parameter is determined, which characterizes, i.e. in particular quantifies or qualifies, the current acoustic environment. During operation in the one program, the assigned dynamic range scheme is modified depending on the situation parameter, so that the dynamic range processor is operated with a modified dynamic range scheme. The dynamic range scheme specified by the program for the current acoustic environment is thus optimized to the situation. In other words, the dynamic range scheme for the automatic gain control is modified depending on the situation. This is based on the consideration that the acoustic environment can change so that the selected dynamic range scheme becomes no longer optimal, but where the change may not be sufficiently great or long-lasting to justify a change in the program, e.g. from a speech program to a music program. An abrupt change of the dynamic range scheme is thus advantageously avoided, instead the dynamic range scheme actually assigned to the environment is adapted depending on the situation and thus, so to speak, further developed or enhanced as part of a fine adjustment. This improves the output of the hearing aid in a way which is pleasant for the user.

In this case, the dynamic range is not adapted depending on the input level or the output level in isolation; rather, the situation parameter is preferably additionally fed to the automatic gain unit and used as an additional control factor or control variable.

The situation parameter is preferably determined by means of a detector. The detector is preferably a part of the hearing aid system. In an alternative, the situation parameter is determined externally with respect to the hearing aid system and transmitted to the hearing aid system, e.g. via a data connection.

Particular preference is given to a design in which the dynamic range processor is a compressor, so that the dynamic range scheme is a compression scheme. Also advantageous is a design in which the dynamic range processor is an expander, so that the dynamic range scheme is an expansion scheme. A compressor and an expander typically produce opposite effects. While a compressor usually limits the gain factor above a threshold, an expander typically increases the gain factor above a threshold. In other words, a compressor amplifies low-level signals more than comparatively high-level signals, and an expander conversely amplifies high-level signals more than relatively low-level signals. Overall, a compressor therefore reduces the dynamic range of a signal and an expander increases the dynamic range of a signal.

Also advantageous is a design in which a compressor and an expander are combined, either as two separate dynamic range processors or jointly as a single dynamic range processor. In a first configuration, the compressor and the expander are used independently of each other so that only one of them is active at a time, e.g. dependent on the situation parameter or a currently installed program of the hearing aid system. In a second design, the compressor and the expander are simultaneously active in a so-called hybrid mode, preferably in such a way that the compressor lowers the level overall and the expander increases the dynamic range again at an operating point, i.e. in a limited frequency and/or level range. In other words, the expander is used to counteract an inherently global compression locally. A reverse design, in which the expander acts globally and the compressor only locally, is entirely possible and suitable.

In a given situation, it is technically entirely possible to use either a compressor or an expander or a combination of both. Which of the three above-mentioned designs is the most useful from an audiological point of view, however, depends on the specific situation. Also, while a combination of compressor and expander in particular may seem contradictory at first, it is technically possible in principle and in some situations also meaningful.

In the following it is assumed without loss of generality that either a compressor or an expander is used. The comments, however, also apply analogously to designs in which both a compressor and an expander are used and in which, depending on the specific design, a number of dynamic range schemes may also arise, to which the described preferred embodiments are then applied as appropriate.

The modification within a given program is ultimately a specific adaptation of the program itself to individual deviations of the current acoustic environment from an idealized environment, or a standard environment predicted to arise when the program was written. One problem with the operation of a hearing aid system is that different situations can occur in different environments at the same time and they require mutually exclusive programs. A particularly important case is the presence of speech in the environment. In order to make this speech maximally intelligible to the user, a program is installed which improves the speech intelligibility. In this case the faithful reproduction of other acoustic signals or sounds is of secondary importance and the recognition of speech is given the main priority for the user instead. In particular, a specific dynamic range scheme designed for maximum speech intelligibility is set and used for this purpose. Conversely, in an environment without speech the main objective is a maximally realistic reproduction of the acoustic environment, and so the best possible sound quality should therefore be aimed for. The best possible sound quality is understood to mean, in particular, that a hearing loss of the user is compensated in the most optimal way, thus a maximum hearing loss compensation is performed. This is particularly important in the case of music, which is sometimes severely distorted by a compression scheme designed for improved speech intelligibility. The same applies to other acoustic signals in the environment which are sometimes so severely distorted that they are no longer recognizable to the user and can no longer be classified. This leads to particular problems when both speech and other sound signals are present in the environment, i.e. when the acoustic environment generally comprises multiple different sound signals to which different programs are assigned for optimal output, e.g. a speech program on the one hand and a music program on the other. In principle, a compromise is possible here such that a program is used that is not optimized in only one direction, but instead tries to render all sound signals in at least a partially faithful way. However, it then becomes clear that none of the sound sources is output optimally, so that with such a program, speech in particular is never optimally intelligible.

In this case, this problem is avoided by fine-tuning the dynamic range scheme within the program. The dynamic range scheme is modified depending on the situation, by at least one situation parameter and advantageously, a plurality of situation parameters, being determined in particular on a recurrent basis, in order to ensure an optimal setting of the dynamic range processor at any given time. This means that the dynamic range processor is adapted to the specific situation. In a suitable design the situation parameter is determined by the hearing aid system itself.

In particular, this can advantageously allow the above-described conflict between speech intelligibility and sound quality to be resolved. For this purpose, in a particularly advantageous design the situation parameter indicates whether speech is present in the environment or not, and the dynamic range scheme is modified in favor of speech intelligibility if speech is present, and otherwise in favor of sound quality. Therefore, from the outset a program is installed which is optimized for maximum sound quality, advantageously a music program. In the case of speech, the intelligibility of the speech is prioritized and the program, specifically the dynamic range scheme, is modified in such a way that maximum speech intelligibility is obtained, in particular without changing the program itself. The modification is advantageously only retained for as long as speech is present. The modification is carried out automatically, with advantageously no user input being required. Nor does the user need to select a special speech program or sound or music program. This means that the program responds directly to the current acoustic environment, without recourse to program selection. The program is therefore not static, but dynamic, on account of the modification being dependent on the situation parameter. This ensures that the user will always experience a maximum sound quality, but in situations with speech, maximum speech intelligibility. In order to determine whether speech is present, the detector is advantageously a speech detector, which in particular examines the input signal for the presence of speech.

The dynamic range scheme defines the behavior of the dynamic range processor in operation and is defined by one or more parameters, more precisely dynamic range parameters, e.g. compression parameters and/or expansion parameters. Suitable dynamic range parameters are, in particular, a compression or expansion threshold, also referred to as a knee point, a compression or expansion ratio, also referred to as compression or expansion for short, a switch-on time, also referred to as attack, and a switch-off time, also referred to as release. The switch-on time and switch-off time of the dynamic range processor are also referred to as time constants. Preferably, the dynamic range scheme is therefore changed by modifying at least one parameter of the dynamic range scheme, wherein the parameter is selected from a set of parameters containing: a switch-on time, a switch-off time, a knee point, a compression ratio in the case of a compressor, an expansion ratio in the case of an expander. A configuration in which the switch-on time or the switch-off time or both are modified depending on the situation is particularly preferred. However, the other parameters are also suitable for modifying the dynamic range scheme.

In this case, in particular, the program is not switched between two different dynamic range schemes, but essentially the same dynamic range scheme, i.e. the same dynamic range algorithm, is used, the parameters of which are adapted depending on the situation, so that the basic concept underlying the dynamic range scheme is preserved and only modified in its specific realization. This is in contrast to published, non-prosecuted German patent application DE 10 2005 061 000 A1 mentioned above, in which depending on the situation, fundamentally different dynamic range schemes are selected. On the other hand, in the present case the parameterization of the dynamic range scheme is dynamically changed.

Dynamic range schemes to maximize sound quality and speech intelligibility are very well known. For example, for maximum sound quality, the aim is to achieve as linear a gain as possible, so that the dynamic range scheme only performs a compression at high input levels, whereas for low and medium input levels there is no compression, for which the compression ratio is, in particular, 1. A knee point, which marks the transition to a higher compression ratio, is then arranged comparatively high, i.e. in comparison to a knee point of a dynamic range scheme for maximum speech intelligibility. Here, for example, the level range of the input signal which contains speech is mapped as closely as possible to the level range audible to the user.

In an advantageous design, the situation parameter is a signal-to-noise ratio of the current acoustic environment and in particular of the input signal, so that the dynamic range scheme is modified depending on the signal-to-noise ratio of the current acoustic environment. The dynamic range scheme is therefore set depending on the relative amplitude of intrusive noise in the environment compared to a useful signal, i.e. a sound signal that the user wants to perceive. This is based on the consideration that with a high signal-to-noise ratio, the useful signal is already sufficiently intelligible to the user and then only a small adaptation in favor of the sound quality, in particular a compression, is necessary and is carried out accordingly. Conversely, a low signal-to-noise ratio indicates a highly noisy environment, so that the dynamic range scheme is modified to be specifically adapted to this situation in order to amplify the useful signal in relation to the interference signals and thus make it more intelligible for the user. A noise detector is advantageously used as a detector for the signal-to-noise ratio, to which in particular the input signal is supplied, which is then used to determine the signal-to-noise ratio in the environment.

In a further advantageous design, the signal-to-noise ratio is a ratio of a signal which originates from a speaker and a noise which originates from one or more other sound sources in the environment. The other sound sources are, for example, other people, e.g. an audience, or equipment, e.g. a vehicle in which the user and the speaker are located. The dynamic range scheme has two-time constants, namely a switch-on time and a switch-off time. In the case of a negative signal-to-noise ratio, at least one of the time constants is reduced and conversely, in the case of a positive signal-to-noise ratio at least one of the time constants is in-creased. "A time constant is reduced" means, preferably, that a fast time constant is set. Similarly, the term "a time constant is increased" means, preferably, that a slow time constant is set. In general, with regard to the switch-on time "fast" means a time of up to 10 ms, and "slow" means a time of 100 ms to 1 s. For the switch-off time, "fast" generally means a time of up to 100 ms, and "slow" means a time from 500 ms to 1 s.

Preferably, in the case of a negative signal-to-noise ratio both time constants are reduced and conversely, in the case of a positive signal-to-noise ratio both time constants are then also increased. This is based on the consideration that environments with a negative signal-to-noise ratio are very demanding for the user. In such a situation, the user benefits in particular from gaps in the input signal, i.e. from short periods of time in which the noise is very low, where 'short' means in particular a length of no more than one second. These gaps are advantageously enhanced with correspondingly fast time constants by the situation-dependent modification of the dynamic range scheme. In this context, 'fast' is understood to mean in particular a time constant of no more than 100 ms. This procedure improves the speech intelligibility in high noise levels, but leads to a poorer sound quality, and this procedure is therefore omitted under correspondingly low noise and comparatively long time constants are selected instead, in particular time constants of longer than 100 ms, so that the adjustment, specifically the com-pression, is weaker overall.

In a further advantageous design, the situation parameter is an environment class, so that the dynamic range scheme is modified depending on the environment class, wherein the environment class is in particular selected from a set of classes, comprising: speech, music, noise. The situation parameter in this case is determined, in particular, by means of a detector which is designed as a classifier. The classifier advantageously forms part of the signal processor and determines the environment class, in particular on the basis of the input signal. If the environment class is music, the dynamic range scheme is modified in a more conservative direction, i.e. when compression is used it is compressed less, for example, than for speech. For speech, the dynamic range scheme is then modified to maximize speech intelligibility. This is advantageous when used in a concert or similar environments in which no speech is present. The dynamic range scheme is then modified with a view to obtaining the most faithful reproduction of music, rhythms and melodies, so the aim is to achieve the best possible linear amplification for the user.

In a further advantageous design, the situation parameter is a motion pattern so that the dynamic range scheme is selected depending on a motion of the hearing aid system, the motion pattern being selected in particular from a set of motion patterns, containing: a resting position, a walking motion, a running motion, driving. The motion pattern is determined in particular by means of a detector, which is configured as a motion sensor, preferably by means of an acceleration sensor. In this case, a distinction is made between motion and rest. The motion is conveniently further sub-divided into different types of motion, e.g. according to the speed. For example, it is detected whether the user is standing still, walking, or driving in a car. This is based on the idea that in general, the importance of speech intelligibility is different in different environmental situations, and therefore the dynamic range scheme is advantageously modified depending on the motion state or motion behavior of the user.

In a further advantageous design, the situation parameter is a stationarity of the current acoustic environment and in particular of the input signal, so that the dynamic range scheme is modified depending on the stationarity of the current acoustic environment. For the determination of the stationarity, a stationarity detector is used, to which in particular the input signal is fed, on the basis of which the stationarity is determined. In particular, the stationary is a measure of the dynamic range of one or more sound sources in the environment, i.e. a measure of the change in the level of this sound source or sound sources over time. The stationarity thus indicates the dynamic range of the time-dependent level.

In a further advantageous design, the situation parameter is a diffuseness of the current acoustic environment, so that the dynamic range scheme is modified depending on the diffuseness of the current acoustic environment. To determine the diffuseness, a diffuseness detector is conveniently used, to which in particular the input signal is fed, on the basis of which the diffuseness is determined. The diffuseness is similar to the above-described stationarity in the sense that the diffuseness is a measure of a variation in the level in the environment, but now not in a time-dependent, but a location-dependent way. The diffuseness thus indicates how directional the environment is, i.e. whether sound signals come to the user from a certain direction, i.e. directionally, or uniformly from all directions, i.e. diffusely. The diffuseness thus indicates the dynamic range of the direction-dependent level. A very spatially homogeneous level thus leads to a high degree of diffuseness.

In a further advantageous design, the situation parameter is a distance from the hearing aid system, in particular any microphone present, to a sound source, in particular to a speaker, in the current acoustic environment, so that the dynamic range scheme is modified depending on the distance. The distance is determined in particular by means of a distance measuring device as the detector. Since the hearing aid system is worn by the user, the distance between the hearing aid and the sound source also corresponds to the distance between the user and the sound source. This is based on the consideration that more distant sound sources are usually less intelligible and therefore in this case the dynamic range scheme is appropriately modified for a higher speech intelligibility.

In a further advantageous design, the situation parameter is a reverberation time of the current acoustic environment, so that the dynamic range scheme is modified depending on the reverberation time, wherein the dynamic range scheme has two time constants, namely a switch-on time and a switch-off time, wherein the reverberation time is determined on a recurring basis and in the event of an in-crease in the reverberation time, at least one of the time constants is increased and conversely reduced in the event of a decrease in the reverberation time. This is based on the idea that in environments with strong reverberation, a rapid adjustment, specifically a fast compression, thus overall short time constants, tend to be detrimental. The reverberation time is appropriately determined by means of a detector to which the input signal is fed, so that the detector determines the reverberation time based on an analysis of the input signal.

A combination of the different concepts described above is also particularly advantageous. In an advantageous design, a plurality of situation parameters is deter-mined and used to control the automatic gain control. In a suitable design, the same situation parameter is determined redundantly by means of a plurality of detectors of the same type or different types.

In a further advantageous design, the one program is configured as a universal program. The universal program is characterized in particular by the fact that it is not adapted to a specific, predefined situation or used in a specific, limited field of application, but is used in several different situations. In a suitable design, the hearing aid system is operated exclusively by means of the one program, so that a design based on different programs which are adapted and optimized specifically for different environments is dispensed with. Instead, adaptation to a modified acoustic environment takes place by means of the situation-dependent modified dynamic range scheme alone. In another suitable design, in addition to the universal program the hearing aid also has one or more special programs, which are adapted to individual specific situations. Preferably, each special program can be set by the user and is preferably not set automatically. While the special programs are invariable, i.e. for each particular situation they specify fixed and predetermined parameter values specifically for the dynamic range scheme but also generally, the universal program is variable, at least because of the situation-adapted dynamic range scheme. The universal program is therefore generally referred to as an automatic program since it automatically adapts to the environment, where-as the individual special programs are static. The situation parameter in the universal program is fed in particular directly to the automatic gain control and used to control the gain factor. In this case, a manual facility for setting the gain is preferably also omitted. A manual adjustment by the user is advantageously only possible by selecting one of the special programs. All adjustments are carried out automatically and depending on the situation, starting from the universal program, by modifying the dynamic range scheme according to the situation parameter.

In a preferred design, the dynamic range scheme is modified as a function of frequency. This means in particular that one or more parameters of the dynamic range scheme is or are modified differently for different frequencies depending on the situation. The input signal has a frequency spectrum which is now divided into at least two frequency bands. A frequency band is, in particular, a single frequency or a frequency interval. It is advantageous to divide the input signal into a plurality of consecutive frequency bands by means of a filter bank in the signal processor. The frequency bands preferably do not overlap, except for a possible minor overlap at the edges for technical reasons. Depending on the situation parameter, the dynamic range scheme is now not only modified in the same way for the entire frequency spectrum, but specifically for the individual frequency bands. The previously described method in which the dynamic range scheme is modified is thus carried out in parallel in multiple frequency bands. In particular, this can result in further improved compression or expansion. A particular advantage is that the dynamic range scheme is selectively modified for particular frequency bands, ensuring an optimal adaptation to the current acoustic environment. The frequency-dependent modification of the dynamic range scheme is suitable for all the situation parameters described. Also suitable in principle is a design in which compression or expansion or a combination of both is carried out in different frequency bands as required.

In the frequency-dependent modification, the parameter which is changed to modify the dynamic range scheme is thus modified differently in different frequency bands depending on the situation. In a particularly advantageous design the dynamic range scheme is modified by varying the switch-on time of the dynamic range scheme or the switch-off time of the dynamic range scheme or both, as a function of frequency. In other words, the switch-on time or the switch-off time, or both parameters, are changed independently of each other for different frequency bands, so that different time constants may also be obtained for different frequency bands. This means that specific frequency bands are modified selectively with respect to the time constant without also performing the same modification for all other frequency bands.

In a preferred design, a distinction is made between speech frequency bands and speech-free frequency bands, i.e. between frequency bands that contain speech and frequency bands that do not contain speech. A suitable speech frequency band is a frequency band from 800 Hz to 4 kHz or a subset thereof. Suitable speech-free frequency bands are accordingly frequency bands below 800 Hz and above 4 kHz. Alternatively, a more detailed division of the frequency spectrum is carried out, in which the speech frequency bands correspond to individual sounds or formants, and all other frequencies then form speech-free frequency bands. Preferably, a parameter of the dynamic range scheme is varied as a function of frequency by setting the parameter over a particular frequency band according to whether this frequency band is a speech frequency band or a speech-free frequency band. The frequency-dependent modification therefore corresponds to a speech-dependent modification. Overall, this advantageously discriminates the speech frequency bands from the speech-free frequency bands, and for both types of frequency band, the dynamic range scheme is optimally modified. This results, in particular, in improved speech intelligibility. The speech-dependent modification of the dynamic range scheme is also suitable for all the situation parameters described.

In a particularly advantageous combination of the speech-dependent modification with the aforementioned design, the situation parameter is a signal-to-noise ratio of the current acoustic environment and, in particular, of the input signal. In the case of a negative signal-to-noise ratio, on a speech frequency band at least one of the time constants of the dynamic range scheme is reduced as described above, and conversely in the case of a positive signal-to-noise ratio the at least one time constant is increased. In the present case then, conversely, over a speech-free frequency band, in the case of a negative signal-to-noise ratio the at least one time constant is increased and in the case of a positive signal-to-noise ratio the at least one time constant is reduced. The time constant is preferably the switch-off time. "A time constant is reduced" means, preferably, that a fast time constant is set. Similarly, the term "a time constant is increased" means, preferably, that a slow time constant is set.

As an alternative or in addition to the frequency-dependent modification of the time constants, in another suitable design a different parameter of the dynamic range scheme is modified as a function of the frequency, e.g. a compression or expansion ratio, or a respective knee point are changed independently of each other, and thus possibly differently, in different frequency ranges.

The hearing aid system according to the invention has a signal processor which is configured for carrying out a method as described above. Furthermore, the hearing aid system has a receiver for outputting an output signal.

Preferably, the hearing aid system is configured as a hearing aid and has one or more microphones to generate the input signal. For example, the hearing aid is a BTE, ITE, or RIC device. The hearing aid has a housing in which the microphone is housed. Preferably, the signal processor is also arranged in the housing. A battery is advantageously arranged in the housing to supply power to the hearing aid. The receiver is either housed in the housing or connected to the housing via a supply line, in particular a cable. The hearing aid is configured either monaurally with only a single housing, or binaurally, with two housings, each having one or more microphones and each having or being connected to a receiver. The housings of the binaural hearing aid are then worn on different sides of the user's head.

The presence of a microphone in the hearing aid system is not mandatory, so that in a suitable design the hearing aid system does not have a microphone and is configured as a set of headphones, for example.

Other features which are considered as characteristic for the invention are set forth in the appended claims.

Although the invention is illustrated and described herein as embodied in a method for operating a hearing aid system, and a hearing aid system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
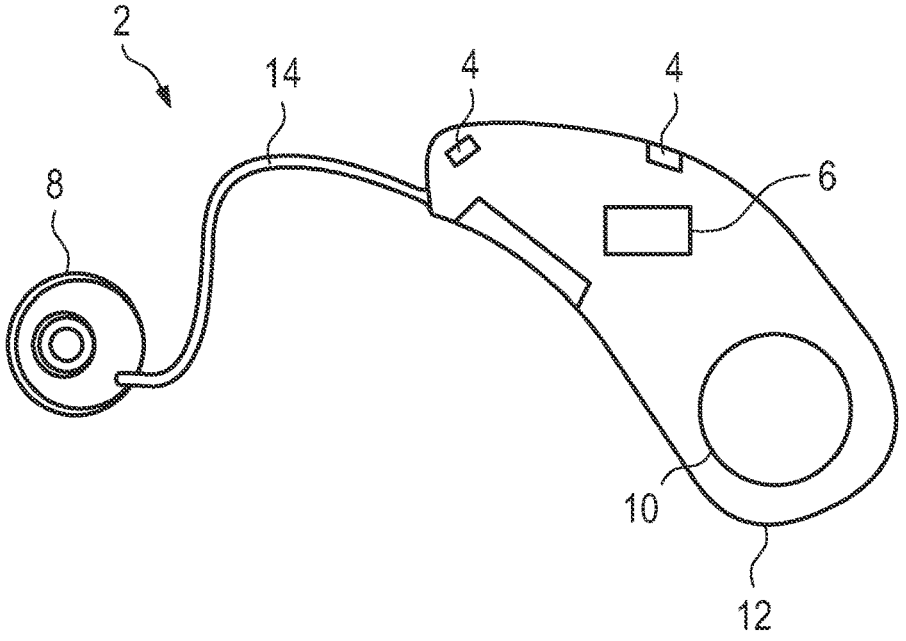
FIG. 1 is an illustration showing a hearing aid system.

Referring now to the figures of the drawings in detail and first, particularly to FIG. 1 thereof, there is shown a hearing aid system 2, which here is configured as a hearing aid, more precisely as an RIC device, which is worn behind the ear by a user, in particular one with a hearing impairment. As a hearing aid, the hearing aid system 2 in the exemplary embodiment has one or more microphones and here two micro-phones 4, for generating an input signal E from sound signals from the environment. The presence of a microphone 4 in the hearing aid system is not mandatory, however, so that a variant of the hearing aid system 2 does not have a microphone and is a set of headphones, for example. Furthermore, the hearing aid system 2 has a signal processor 6 and a receiver 8, in addition to a power supply and a battery 10. The hearing aid system 2 here also has a housing 12, in which the microphones 4, the signal processor 6 and the battery 10 are arranged. The receiver 8 is connected to the housing via a supply line 14 and in FIG. 1 is integrated into an ear-piece, which is inserted into the user's ear.

In operation, the microphones 4 convert the sound signals in the environment into an input signal E, which is fed to the signal processor 6 and modified by it. In this way, the signal processor 6 generates an output signal A, which is thus a modified input signal E. In this case, the input signal E is amplified with a certain gain factor V. The output signal A, i.e. the amplified input signal E, is finally output to the user by means of the receiver 8. The input signal E and the output signal A are electrical signals. The receiver 8 then converts the output signal A into a sound signal.

The hearing aid system 2 is either monaural or binaural. For example, a binaural hearing aid system 2 then has two housings 12 with the associated components as shown in FIG. 1, wherein the signal processor 6 does not need to be identical in both cases.

Figure 2:
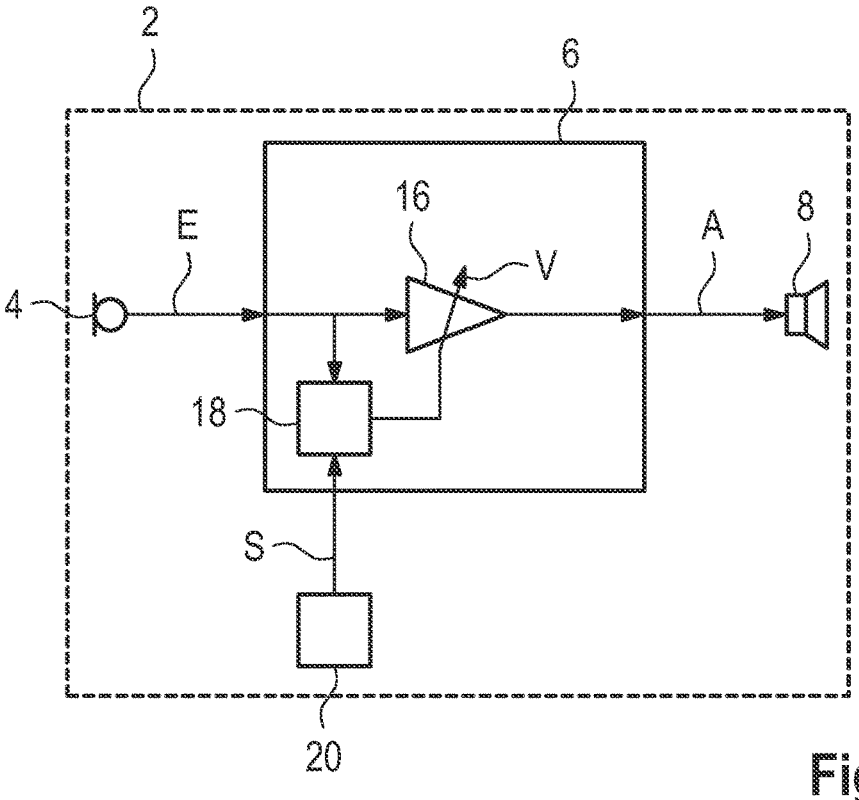
FIG. 2 is a block circuit diagram of the hearing aid system.

In FIG. 2, the hearing aid system 2 is shown as a block circuit diagram. The signal processor 6 has an amplifier 16, to which the input signal E is fed and which then amplifies this signal and forwards it to the receiver 8 as the output signal A. The amplification in the amplifier 16 is carried out with a gain factor V, which is adjusted by an automatic gain control. The latter has a dynamic range processor 18 for this purpose. The hearing aid system 2 is operated in a program to which a specific dynamic range scheme is assigned, with which the dynamic range processor 18 is operated during operation in the one program. The respective dynamic range scheme defines the gain factor V as a function of a level of the input signal E. The function is characterized by various parameters, e.g. in this case by one or more knee points, one or more compression or expansion ratios, a switch-on time (attack), a switch-off time (release) or a combination of these.

The dynamic range processor 18 in this case is either a compressor or an ex-pander or a combination of these. In an exemplary embodiment not shown, there are two dynamic range processors 18, one of which is a compressor and the other an expander, wherein the explanations given for the exemplary embodiment shown then apply analogously.

In addition, a situation parameter S is determined, which characterizes the current acoustic environment and which is then used during operation in the one program to modify the assigned dynamic range scheme. The dynamic range processor 18 is then operated with a modified dynamic range scheme depending on the situation parameter S. To determine the situation parameter S a detector 20 is arranged, which here is part of the hearing aid system 2. The detector 20 is generally connected to the signal unit 6 and specifically to the automatic gain control, in this case to the dynamic range processor 18.

For example, the detector 20 is a speech detector that determines whether speech is present in the environment. Alternatively, the detector 20 determines a signal-to-noise ratio in the environment as the situation parameter S. For this purpose, in a suitable design the input signal E is fed to the detector 20, so that the latter determines the signal-to-noise ratio of the input signal E as the situation parameter S. Alternatively, the detector 20 is a classifier, which uses the input signal E, for example, to assign the environment to a specific environment class. Alternatively, the detector 20 is a motion detector, for example an acceleration sensor, which determines a movement pattern as the situation parameter S. The motion detector determines, for example, whether the user is moving or not, how fast the user is moving, or in which direction or a combination of these. Alternatively, the detector 20 is a stationarity detector, which determines the stationarity of the environment, i.e., the temporal dynamic range of the sound signals from the environment. For this purpose, for example, the detector 20 is supplied with the input signal E, the stationarity of which, i.e. its temporal variation, is then determined by the detector 20 and output as the situation parameter S. Alternatively, the detector 20 is a diffuseness detector, which determines the diffuseness of the environment, i.e., the spatial distribution of the sound signals in the environment. For this purpose, for example, the input signal E is fed to the detector 20, the directedness of which, i.e. its spatial level distribution, is then determined by the detector 20 and output as the situation parameter S. Alternatively, the detector 20 is a distance measuring device which determines the distance of the hearing aid system 2 from a sound source in the environment and then outputs this distance as the situation parameter S. Alternatively, the detector 20 determines the reverberation time in the environment, e.g. by analyzing the input signal E. In a variant not shown, a plurality of identical or different detectors 20 mentioned above are combined.

Figure 3:
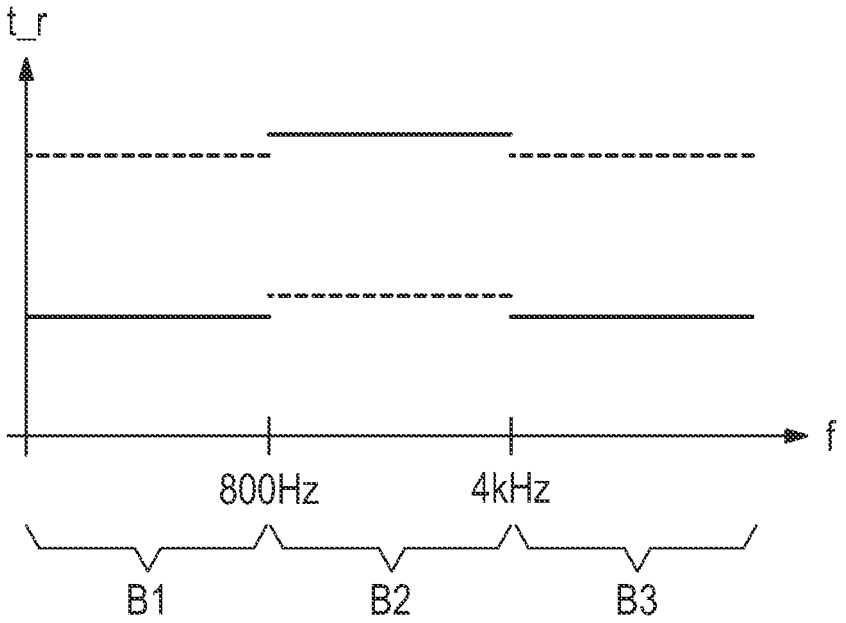
FIG. 3 is a graph showing a frequency-dependent modification of a parameter of a dynamic range scheme.

FIG. 3 shows an exemplary embodiment of a frequency-dependent modification of the dynamic range scheme. In this case, a parameter of the dynamic range scheme is varied differently for different frequencies f depending on the situation. The input signal E has a frequency spectrum, which here is divided into three frequency bands B1-B3. Depending on the situation parameter S, the dynamic range scheme is now not merely modified in the same way for the entire frequency spectrum, but specifically for the individual frequency bands B1-B3. The previously described method, in which the dynamic range scheme is modified, is thus carried out in parallel, so to speak, in the frequency bands B1-B3. In the exemplary embodiment shown, the switch-off time t_r of the dynamic range scheme is changed as a function of frequency. In addition, a distinction is made between speech frequency bands B2, in this case from 800 Hz to 4 kHz, and speech-free frequency bands B1, B3, in this case below 800 Hz and above 4 kHz. In a variant not shown here, a more detailed division of the frequency spectrum is carried out, in which the speech frequency bands correspond to individual sounds or formants, and all other frequencies then form speech-free frequency bands.

The switch-off time t_r and in general a parameter of the dynamic range scheme is in this case varied as a function of frequency by setting it on a particular frequency band B1-B3 according to whether this frequency band B1-B3 is a speech frequency band B2 or a speech-free frequency band B1, B3. The frequency-dependent modification therefore corresponds to a speech-dependent modification. In FIG. 3, this is combined with a design in which the situation parameter S is a signal-to-noise ratio of the current acoustic environment. The frequency-dependent switch-off time t_r in the case of a positive signal-to-noise ratio is shown in FIG. 3 by solid lines and in the case of a negative signal-to-noise ratio by dashed lines. In the case of a negative signal-to-noise ratio, over the speech frequency band B2 the switch-off time t_r is reduced and conversely, in the case of a positive signal-to-noise ratio the switch-off time t_r is increased. On the other hand, conversely over the speech-free frequency bands B1, B3 in the case of a negative signal-to-noise ratio the switch-off time t_r is increased and in the case of a positive signal-to-noise ratio the switch-off time t_r is reduced. "Reduced" here means that a fast switch-off time t_r is set, and "increased" means that a slow switch-off time t_r is set. However, the same procedure is in principle also suitable for the switch-on time.

As an alternative or in addition to the frequency-dependent modification of the time constants, in another suitable design a different parameter of the dynamic range scheme is modified as a function of the frequency, e.g. a compression or expansion ratio or a respective knee point are changed independently of each other, and thus possibly differently, in different frequency bands.

LIST OF REFERENCE SIGNS

2 hearing aid system
4 microphone
6 signal processor
8 receiver
10 battery
12 housing
14 supply line
16 amplifier
18 dynamic range processor
20 detector
A output signal
B1, B3 speech-free frequency band
B2 speech frequency band
E input signal
S situation parameter
t_r switch-off time
V gain factor

The invention claimed is:

1. A method for operating a hearing aid system in a current acoustic environment, the hearing aid system having a signal processor, which comprises the steps of:

generating, via the signal processor, an output signal from an input signal by amplifying the input signal by a gain factor;

outputting the output signal via a receiver of the hearing aid system;

setting the gain factor by an automatic gain control, which has a dynamic range processor operated with a dynamic range scheme defining the gain factor in dependence on a level of the input signal;

operating the hearing aid system in a program to which the dynamic range scheme is assigned, with which the dynamic range processor is operated during operation in the program;

determining at least one situation parameter characterizing the current acoustic environment, the at least one situation parameter indicates whether speech is present in the current acoustic environment or not; and during operation in the program, modifying an assigned dynamic range scheme depending on the at least one situation parameter, so that the dynamic range processor is operated with a modified dynamic range scheme, the dynamic range scheme is modified in favor of speech intelligibility if the speech is present, and otherwise in favor of sound quality.

2. The method according to claim 1, wherein the dynamic range processor is a compressor, so that the dynamic range scheme is a compression scheme.

3. The method according to claim 1, wherein the dynamic range processor is an expander, so that the dynamic range scheme is an expansion scheme.

4. The method according to claim 1, wherein:

the dynamic range scheme is modified by changing at least one parameter of the dynamic range scheme; and the at least one parameter is selected from the group of parameters consisting of: a switch-on time, a switch-off time, a knee point, a compression ratio, and an expansion ratio.

5. The method according to claim 1, wherein the at least one situation parameter is a signal-to-noise ratio of the current acoustic environment, so that the dynamic range scheme is modified depending on the signal-to-noise ratio of the current acoustic environment.

6. The method according to claim 5, wherein:

the signal-to-noise ratio is a ratio of a signal which originates from a speaker and a noise which originates from at least one sound source;

the dynamic range scheme has two time constants, namely a switch-on time and a switch-off time; and in a case of a negative signal-to-noise ratio at least one of the time constants is reduced and conversely, in a case of a positive signal-to-noise ratio at least one of the time constants is increased.

7. The method according to claim 1, wherein:

the at least one situation parameter is an environment class, so that the dynamic range scheme is modified depending on the environment class; and the environment class is selected from the group of classes consisting of: speech, music, and noise.

8. The method according to claim 1, wherein:

the at least one situation parameter is a motion pattern, so that the dynamic range scheme is modified depending on a motion of the hearing aid system; and the motion pattern is selected from the group of motion patterns consisting of: a resting position, a walking motion, a running motion, and driving.

9. The method according to claim 1, wherein the at least one situation parameter is a stationarity of the current acoustic environment and of the input signal, so that the dynamic range scheme is modified depending on the stationarity of the current acoustic environment.

10. The method according to claim 1, wherein the at least one situation parameter is a diffuseness of the current acoustic environment, so that the dynamic range scheme is modified depending on the diffuseness of the current acoustic environment.

11. The method according to claim 1, wherein the at least one situation parameter is a distance from the hearing aid system to a sound source, in the current acoustic environment, so that the dynamic range scheme is modified depending on the distance.

12. The method according to claim 1, wherein:

the at least one situation parameter is a reverberation time of the current acoustic environment, so that the dynamic range scheme is modified depending on the reverberation time;

the dynamic range scheme has two time constants, namely a switch-on time and a switch-off time; and the reverberation time is determined on a recurring basis, and in an event of an increase in the reverberation time, at least one of the time constants is increased and conversely reduced in an event of a decrease in the reverberation time.

13. The method according to claim 1, wherein the one program is a universal program.

14. The method according to claim 1, wherein the dynamic range scheme is modified as a function of frequency.

15. The method according to claim 14, wherein the dynamic range scheme is modified by changing a switch-on time of the dynamic range scheme or a switch-off time of the dynamic range system, or both, as a function of frequency.

16. A method for operating a hearing aid system in a current acoustic environment, the hearing aid system having a signal processor, which comprises the steps of:

generating, via the signal processor, an output signal from an input signal by amplifying the input signal by a gain factor;

outputting the output signal via a receiver of the hearing aid system;

setting the gain factor by an automatic gain control, which has a dynamic range processor operated with a dynamic range scheme defining the gain factor in dependence on a level of the input signal;

operating the hearing aid system in a program to which the dynamic range scheme is assigned, with which the dynamic range processor is operated during operation in the program;

determining at least one situation parameter characterizing the current acoustic environment;

making a distinction between speech frequency bands and speech-free frequency bands;

changing a parameter of the dynamic range scheme as a function of frequency by setting the parameter over a particular frequency band according to whether the particular frequency band is the speech frequency band or the speech-free frequency band; and during operation in the program, modifying an assigned dynamic range scheme depending on the at least one situation parameter and frequency, so that the dynamic range processor is operated with a modified dynamic range scheme.

17. The method according to claim 16, wherein:

the at least one situation parameter is a signal-to-noise ratio of the current acoustic environment;

in a case of a negative signal-to-noise ratio over the speech frequency band, at least one time constant is reduced and in a case of a positive signal-to-noise ratio the at least one time constant is increased; and over the speech-free frequency band, in a case of a negative signal-to-noise ratio the at least one time constant is increased and in the case of a positive signal-to-noise ratio the at least one time constant is reduced.

18. A hearing aid system, comprising:

a signal processor configured to carry out a method according to claim 1; and a receiver for outputting the output signal.

* * * * *